United States Patent [19]

King

[11] Patent Number: 4,511,101

[45] Date of Patent: Apr. 16, 1985

[54] REELING DEVICE

[76] Inventor: William King, 79 Allison Rd., Elsternwick 3185 Victoria, Australia

[21] Appl. No.: 414,380

[22] PCT Filed: Dec. 31, 1982

[86] PCT No.: PCT/AU81/00195

§ 371 Date: Aug. 31, 1982

§ 102(e) Date: Aug. 31, 1982

[87] PCT Pub. No.: WO82/02376

PCT Pub. Date: Jul. 22, 1982

[30] Foreign Application Priority Data

Jan. 2, 1981 [AU] Australia ..... PE07118

[51] Int. Cl.[3] ..... B65H 75/48

[52] U.S. Cl. ..... 242/107.7

[58] Field of Search ..... 242/107.7, 107.6, 107.12

[56] References Cited

U.S. PATENT DOCUMENTS

| | | | |
|---|---|---|---|
| 2,391,840 | 12/1945 | Meletti | 242/107.7 |
| 2,563,714 | 8/1951 | Foster | 242/107.7 |
| 2,976,959 | 3/1961 | Husted | 242/107.6 X |
| 2,990,132 | 6/1961 | Mills | 242/107.7 |
| 3,384,108 | 5/1968 | Kern, Jr. | 242/107.7 |
| 3,490,715 | 1/1970 | Nicpon | 242/107.7 |
| 3,590,656 | 7/1971 | Lloyd, Jr. | 242/107.7 X |
| 4,227,661 | 10/1980 | King et al. | 242/107.7 |

FOREIGN PATENT DOCUMENTS

| | | |
|---|---|---|
| 7527074 | 4/1977 | France . |
| 723703 | 2/1955 | United Kingdom . |

*Primary Examiner*—John M. Jillions

*Attorney, Agent, or Firm*—Andrus, Sceales, Starke & Sawall

[57] ABSTRACT

A reeling device including a reel for holding, paying out and winding in a linearly extendable, flexible member, means for biasing said reel in a direction of rotation for winding in said member and a latching mechanism adapted to prevent winding in of said member and constructed and arranged such that on paying out said latching mechanism is sequentially and repetitively put into and out of condition to prevent winding in of said member.

5 Claims, 7 Drawing Figures

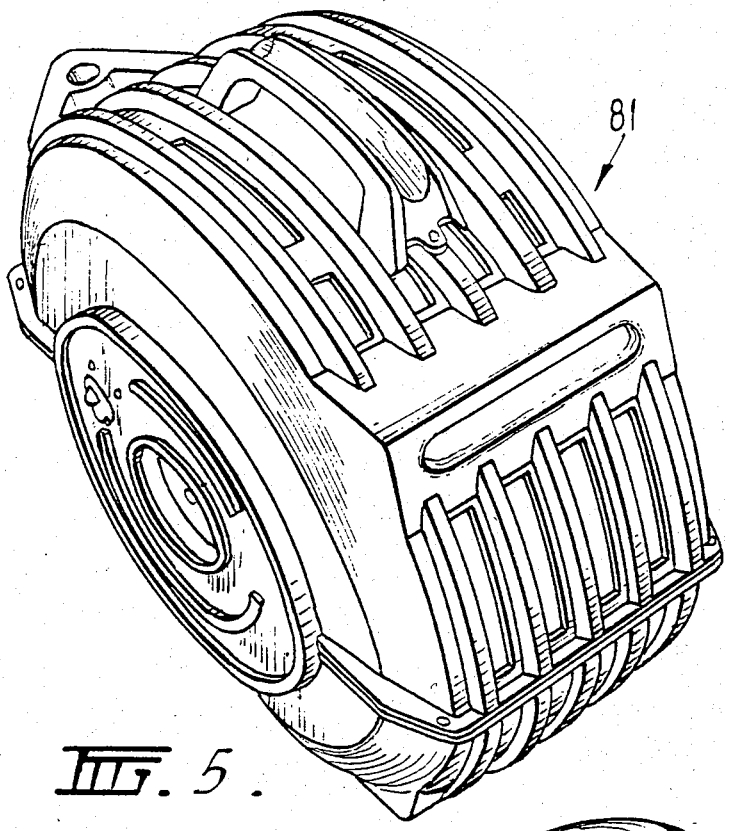
FIG. 5.
FIG. 6.
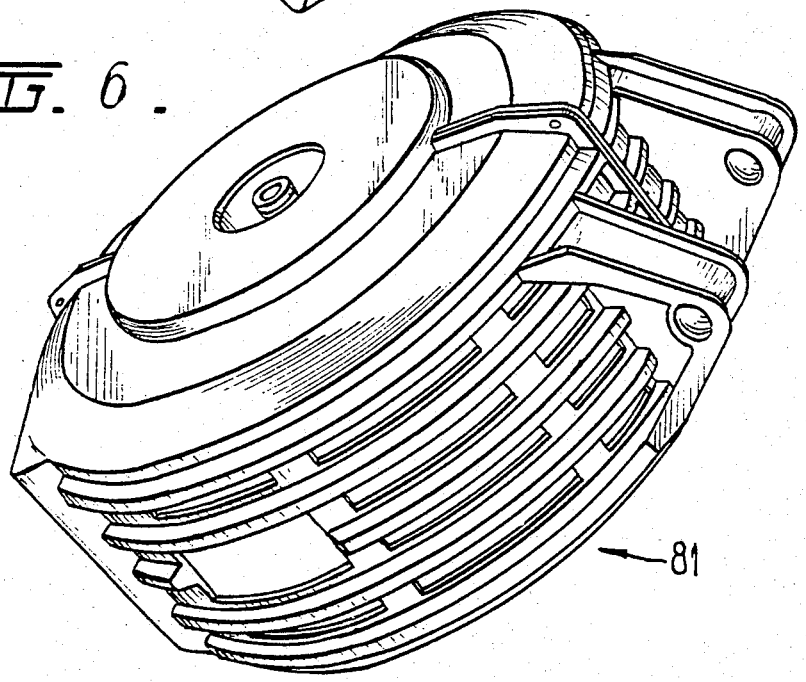

REELING DEVICE

This invention relates to a latching mechanism and to a reeling device.

The reeling devices in accordance with this invention can be used to reel anything desired but most application will be found in reeling hoses or electrical cable or flex cables.

The present invention provides in one aspect a reeling device including a reel for holding, paying out and winding in a linearly extendable, flexible member, means for biasing said reel in a direction of rotation for winding in said member and a latching mechanism adapted to prevent winding in of said member and constructed and arranged such that on paying out said latching mechanism is sequentially and repetitively put into and out of condition to prevent winding in of said member.

Preferably there is a first means for putting the latching mechanism into said condition and a second means for putting the latch mechanism out of said condition. Said first means and said second means may be associated with the reel or with a casing or support for the reel.

The latching mechanism may include a ratchet wheel and a pawl. The pawl is preferably biased by an over-the-centre mechanism to be in a first or a second position in which it can and cannot engage with the ratchet wheel to prevent winding in of said member. The ratchet wheel may have a ramp surface for moving the pawl from the first position to the second position and means for moving the pawl from the second position to the first position may also be associated with the ratchet wheel but at an angularly rotated position.

The latching means may be able to latch one or more times per rotation of the reel.

Figure 2:
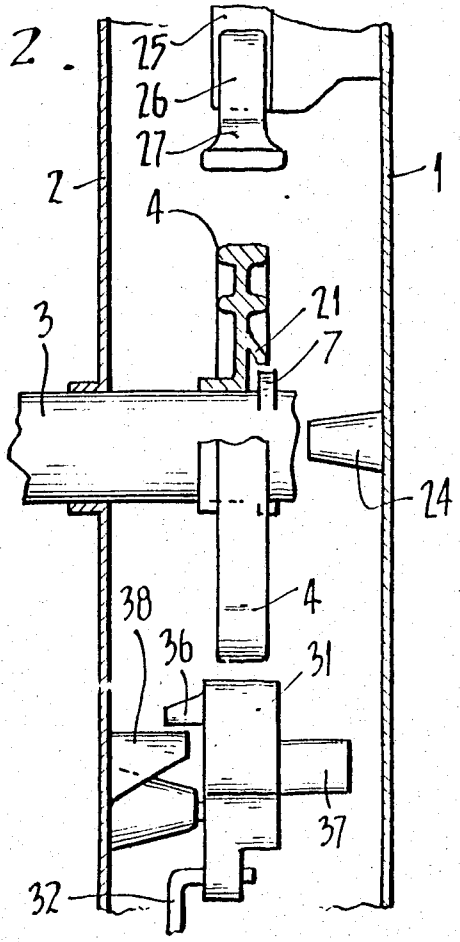
Figure 1:
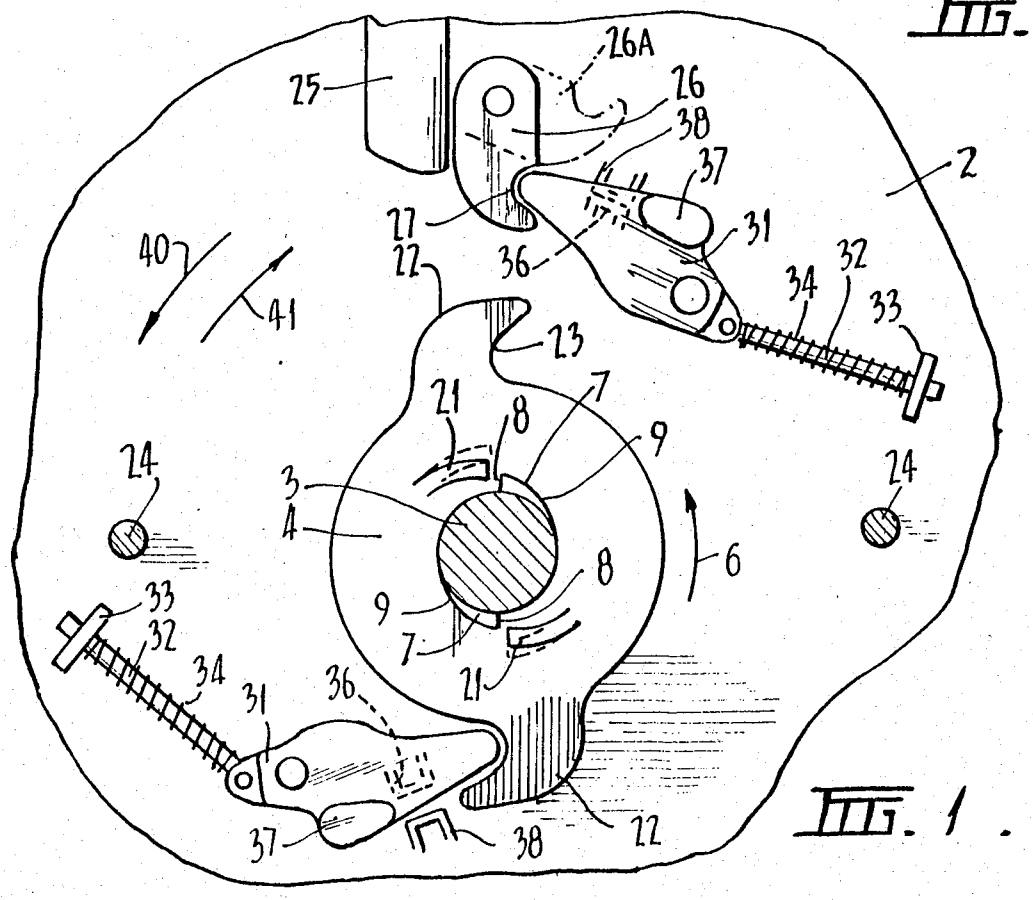
Figure 4:
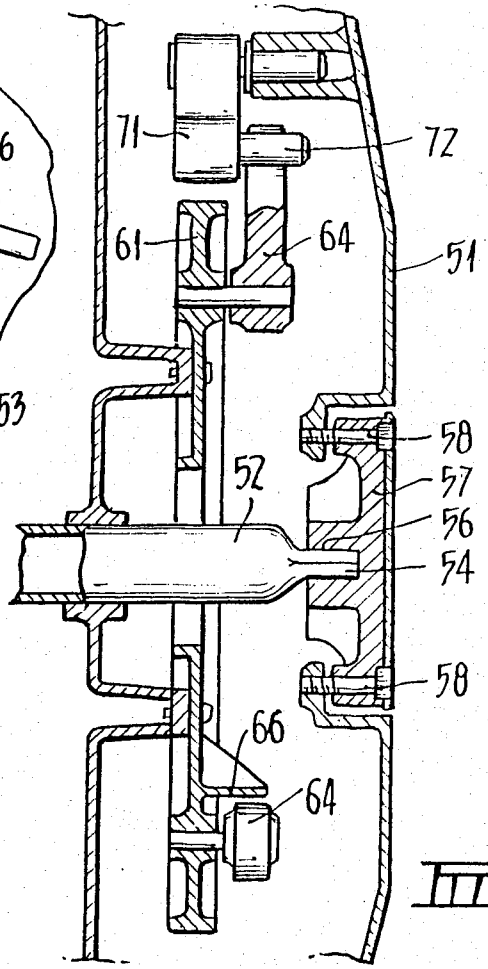
Figure 3:
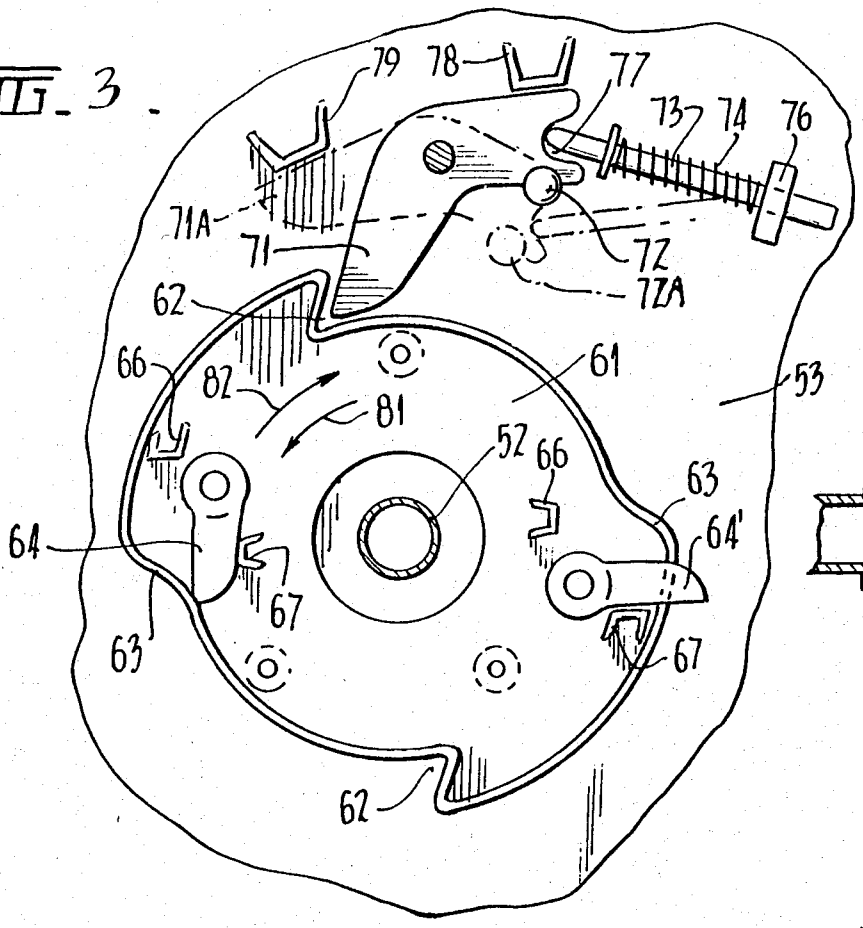
Figure 7:
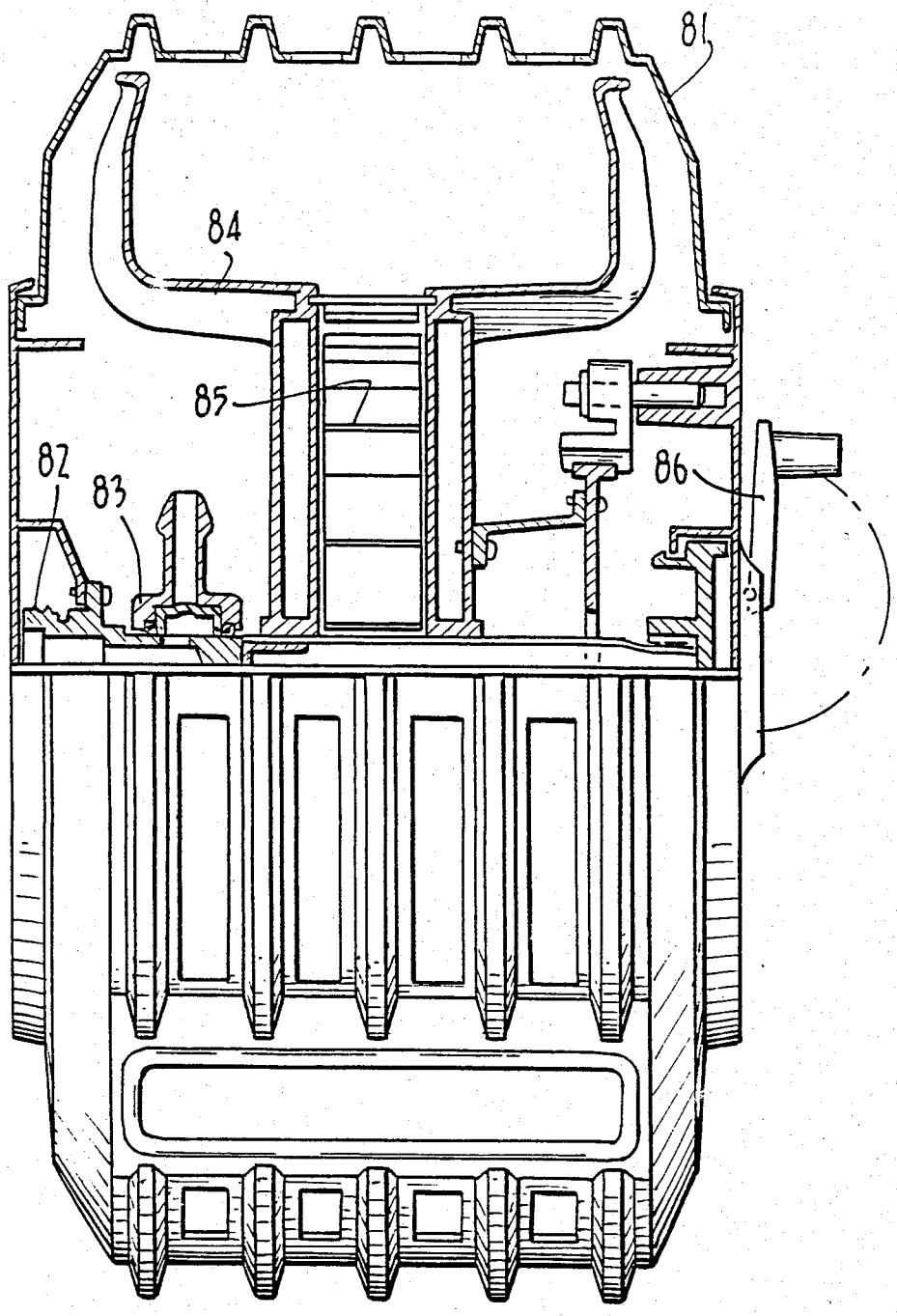

Constructions of latching mechanisms and winding devices in accordance with this invention will now be described with the aid of the accompanying drawings in which:

FIG. 1 is a side elevation of the latching mechanism forming part of a winding device, FIG. 2 is a cross-section through the mechanism of FIG. 1 and shows parts of the winding device, FIG. 3 is a side elevation of another latching mechanism forming part of another winding device, FIG. 4 is a cross-section through the mechanism of FIG. 3 and shows parts of the winding device, FIG. 5 is a top perspective view of a reeling device in accordance with this invention, FIG. 6 is a bottom perspective view of the reeling device of FIG. 5, and FIG. 7 is a partial cross-sectional view of the reeling device of FIG. 5.

The latching mechanism and winding device shown in FIGS. 1 and 2 comprises an outer casing of which one part 1 is shown and a drum or reel of which one part 2 is shown which is mounted to the casing on a shaft 3 to rotate thereon. The shaft 3 is fixed against rotation.

A cam plate 4 is mounted on the shaft 3 and is free to rotate on the shaft in the direction of the arrow 6 but is restricted against rotation in the opposite direction by projections 7 on the shaft 3 which have abutment surfaces 8 and ramp surfaces 9, and flexible arms 21 on the cam plate 4 which can ride up the ramp surfaces 9 for rotation in the direction of the arrow 6 or abut against the abutment surfaces 8 to restrict against rotation in the opposite direction. The cam plate 4 has ramp surfaces 22 and recesses 23.

Secured to the outer casing part 1 are abutments 24, an abutment 25 and a pivotally mounted latch 26 having a latching recess 27. The latch 26 may be gravity biased if oriented as shown or spring-loaded if some other mounting position is desired.

Secured to the drum 2 at 180° spacings are two pawl mechanisms each comprising a pivotally mounted pawl 31, an over-the-centre lever 32 which passes through a guide 33 fixed to the drum 2 and a biasing spring 34. An abutment 36 and a projection 37 are carried by each pawl 31 and abutments 38 are carried by the drum 2. The abutments 24 are radially in line with the projections 37.

Spring means, not shown, biases the drum 2 in the recoil direction indicated by arrow 40.

The manner of operation of the winding device of FIGS. 1 and 2 is as follows.

Payout

From a position in which a hose, cable or other element is fully wound on the drum 2 the hose etc. is pulled upon to pay out and turns the drum 2 in the direction of the arrow 41 in FIG. 1. The pawls 31 will revolve about the shaft 3 in the direction of arrow 41 and will ride on the cam plate 4 and tend to urge it also in the direction of arrow 41 but such urging will be resisted by interengagement of the arms 21 and abutment surfaces 8.

In consequence of riding on the cam plate 4 the pawls 31 will engage the ramp surfaces 22 which will move the pawls to the over-the-centre position shown in the upper part of FIG. 1 in which abutments 36 and 38 are in contact and in which positions the pawls 31 are stable and out of contact with the cam plate 4.

A pawl 31 in the over-the-centre position shown in the upper part of FIG. 1 moving in the direction of arrow 41 will move the latch 26 aside to the position shown by dash line 26A as it passes latch 26.

Continued movement in the direction of arrow 41 of pawls 31 in the over-the-centre position will cause the projections 37 to engage the abutments 24 which will have the effect of returning the individual pawls 31 to the cam plate 4 contacting condition where they will again be acted upon by the ramp surfaces 22 to return to the over-the-centre position. Thus, pay out will continue with the pawls moving between the over-the-centre position and the cam plate 4 contacting condition.

Recoil

When both of the pawls 31 are in the cam plate 4 contacting condition recoil under the influence of the spring bias acting on the drum 2 can occur. In recoil the pawls 31 will locate in the recesses 23 and turn the cam plate 4 in the direction of arrow 6 which the drum 2 turns in the same direction (also arrow 40). The arms 21 and surfaces 8 do not restrict recoil.

Latching

To latch the drum 2 against recoil it is necessary that one of the pawls 31 in the over-the-centre position should locate in recesss 27. Such locating will occur if a pawl 31 has been moved to the over-the-centre position by the uppermost one (with respect to FIG. 1) of the surfaces 22 but has not yet contacted the right hand side one (with respect to FIG. 1) of the abutments 24 and thus has not yet come out of the over-the-centre position and has passed the latch 26, allowing that one of the pawls 31 to contact latch 26 by allowing the drum to move in the recoil direction indicated by the arrow 40 will cause the pawl to enter the recess 27 and move the latch 26 to contact the abutment 25 to prevent further movement of the pawl and the drum 2.

If no pawl 31 is in a position to engage the latch 26 then slight movement (usually not more than 120°) of the drum 2 in the direction of arrow 41 will put one of the pawls 31 in the over-the-centre position for engaging the latch 26.

The above described latch mechanism and winding device has the advantage that recoil can occur at any speed and that accidental latching is unlikely to occur. Further, once latching has been freed it cannot reoccur in a recoil even if recoiling is stopped temporarily unless the drum 2 is first moved in the pay out direction through at least about 30°.

The latch mechanism and winding device of FIGS. 3 and 4 includes an outer casing 51, a shaft 52 supported by the outer casing 51 and a hose winding drum 53 mounted on the shaft 52. Spring means (not shown) is mounted between the shaft 52 and drum 53 for the purpose of biasing a hose wound on the drum for recoil. That spring means may be tensioned as desired by rotating the shaft 52 and for this purpose the end 54 of the shaft 52 is flattened and received in a slot 56 in a body 57 which is rotatable with respect to the casing 51. The body 57 may be held in a particular rotated position by screws passed through holes 58 into the casing 51.

Mounted to the drum 53 is a cam plate 61. The cam plate 61 has recesses 62, ramp portions 63, pivotable levers 64 and 64' and abutments 66 and 67 defining the limits of movement of the levers 64 and 64'.

Mounted to the casing 51 is a pivotable latch 71 having a projecting pin 72 and which is biased by an over-the-centre mechanism comprising a rod 73 which is spring loaded by a spring 74 and which passes through a guide 76 attached to the casing 51 and locates in a notch 77 in the latch 71. Abutments 78 and 79 define limits of movement of the latch 71. The latch 71 will be stable in the full line and dash line (71A) positions shown in FIG. 3.

The manner of operation of the winding device of FIGS. 3 and 4 is as follows:

Pay out

From a position in which a hose cable or other element is fully wound on the drum 53 the hose or etc. is pulled upon to pay out and turns the drum 53 in the direction of arrow 81.

Assuming that the latch 71 is in the dash line position 71A shown in FIG. 3 the turning of the cam plate 61 will result in one of the levers 64 or 64' approaching the latch 71 to be in the extended position (shown to the right in FIG. 3) as a result of gravity centrifugal force or, if desired, spring bias and against the abutment 67. The lever 64 or 64' will then contact the pin 72 in the 72A position and will move the latch 71 from the dash line (71A) position to the full line position but immediately thereafter the latch 71 will contact the ramp surface 63 and be moved to the dash line (71A) position where it will be stably held by the over-the-centre mechanism. Thus, pay out occurs with the latch 71 cycling between the full line position and the dash line (71A) position.

Recoil

At any one instant the latch 71 will be in either the full line position or dash line (71A) position and if the latch 71 is in the latter position there is no impediment to recoil and the drum 53 will recoil in the direction of arrow 82 to wind in the hose or etc. when the hose is released.

However, if the latch 71 is in the full line position recoil will not occur as the drum in turning in the direction of arrow 82 will cause the latch 71 to locate in one of the recesses 62 to prevent further recoil. This situation should be easily and immediately discernible by a user who need only pull upon the hose or etc. in the pay out direction (drum 53 rotation in the direction of arrow 81) until engagement of the latch 71 and one of the ramp surfaces 63 has moved the latch 71 to the dash line (71A) position whereafter recoil can occur.

Latching

If the latch 71 is in the full line position then the latch 71 will engage with one of the recesses 62 to prevent recoil.

If the latch 71 is in the dash line (71A) position recoil can occur and latching will not be had but this too will be immediately discernible and a user need only pull upon the hose or etc. in the pay out direction (drum 53 rotation in the direction of arrow 81) until engagement of the latch 71 and one of the levers 64 or 64' causes the latch 71 to be put in the full line position whereafter release of the hose or etc. will allow rotation of the drum 53 in the direction of the arrow 82 until the latch 71 engages one of the recesses 62 to prevent recoil.

The construction described with respect to FIGS. 3 to 4 allows recoil at any speed and undesired latching during recoil is unlikely to occur similarly as in respect of the FIGS. 1 and 2 construction.

The reeling device shown in FIGS. 5–7 may have either of the latching mechanisms described with respect to FIGS. 1 and 2 or FIGS. 3 and 4.

The reeling device of FIGS. 5–7 comprises an outer casing 81, an inlet hose connector 82, a swivel 83 to which a hose can be connected, a drum 84 for holding hose, a spring 85 for biasing the drum 84 in a hose recoiling direction and a handle 86 for tensioning the spring 85.

Modifications and adaptations may be made to the above described without departing from the spirit and scope of this invention which includes every novel feature and combination of features disclosed herein.

I claim:

1. A reeling device including a casing, a reel for holding, paying-out and winding-in a linearly extendible, flexible member, means for biasing said reel in a direction of rotation for winding-in said member and a latching mechanism for preventing and permitting winding-in of said member, the latching mechanism comprising a pawl (71) mounted solely to pivot between a first position and a second position about a pivot axis fixed to the casing, a body (61) mounted to the reel for rotation therewith, said body having a cam surface (63) which, when the reel rotates in a first part of a rotation in the pay-out direction, moves the pawl from the first position, in which it is in contact with the cam surface, to the second position, in which it is remote from the body, said body having an abutment (64, 64') which, when the reel rotates in a second part of said rotation in the pay-out direction, moves the pawl from the second position to the first position, said abutment being pivotally mounted on said body to extend therefrom when the reel is rotated in the pay-out direction;

said cam surface and the abutment operating as the reel rotates in the pay-out direction to put the pawl sequentially and repetitively into the second position and the first position; and said body having a pawl engaging means (62) adapted to engage the pawl, when the pawl is in the first position and the reel rotates in the winding-in direction whereby to prevent winding-in and which does not engage the pawl when the pawl is in the second position when the reel rotates in the winding-in direction so that winding-in is not prevented and can take place.

2. A reeling device as claimed in claim 1 wherein the pawl (71) is located above the body and the abutment (64, 64') is biased by gravity to extend from the body during upward motion of the abutment when the reel is rotated in the pay-out direction.

3. A reeling device as claimed in claim 1 wherein the pawl engaging means (62) is a recess in the body adapted to capture the pawl, when the pawl is in the first position and the reel rotates in the winding-in direction, whereby to prevent winding-in.

4. A reeling device including a casing, a reel for holding, paying-out and winding-in a linearly extendible, flexible member, means for biasing said reel in a direction of rotation for winding-in said member and a latching mechanism for preventing and permitting winding-in of said member, the latching mechanism comprising:

a pawl (31) mounted solely to pivot between a first position and a second position about a pivot axis fixed to the reel and which will rotate with the reel in the pay-out direction and in the winding-in direction a body (4) mounted to rotate about the same axis as the reel but only in the winding-in direction, said body having a cam surface (22) which, when the reel rotates in a first part of a rotation in the pay-out direction and the pawl rotates with the reel, moves the pawl from the first position, in which it is in contact with the cam surface, to the second position, in which it is remote from the body, the casing having an abutment (24) which, when the reel rotates in a second part of said rotation in the pay-out direction, moves the pawl from the second position to the first position, the cam surface and the abutment thereby operating as the reel rotates in the pay-out direction to put the pawl sequentially and repetitively into the second position and the first position; and said casing having a pawl engaging means (26) adapted to engage the pawl, when the pawl is in the second position, when the reel rotates in the winding-in direction to prevent winding-in and which does not engage the pawl when the pawl is in the first position when the reel rotates in the winding-in direction so that winding-in is not prevented and can take place.

5. A reeling device as claimed in claim 4, wherein the pawl engaging means is a pivoted latch adapted to be moved aside by the pawl when the reel rotates in the pay-out direction and to engage the pawl, when the pawl is in the second position, when the reel rotates in the winding-in direction to prevent winding-in.

* * * * *